United States Patent [19]

Fry

[11] 3,942,470

[45] Mar. 9, 1976

[54] DRY PROCESS ENAMEL APPARATUS FOR BATHTUBS

[75] Inventor: Ralph Fry, Warren, Pa.

[73] Assignee: Ferro Corporation, Cleveland, Ohio

[22] Filed: Apr. 8, 1974

[21] Appl. No.: 458,518

Related U.S. Application Data

[63] Continuation-in-part of Ser. No. 324,327, Jan. 16, 1973, Pat. No. 3,810,250, which is a continuation-in-part of Ser. No. 250,786, May 5, 1972, abandoned.

[52] U.S. Cl. ..... 118/310; 118/321; 118/323

[51] Int. Cl.[2] ..... B05B 7/14

[58] Field of Search ..... 118/308, 310, 311, 318, 118/321, 323

[56] References Cited

UNITED STATES PATENTS

| | | | |
|---|---|---|---|
| 707,490 | 8/1902 | Zwermann | 118/308 |
| 710,443 | 10/1902 | DuPont | 118/308 |
| 759,351 | 5/1904 | Dawes | 118/308 |
| 3,132,038 | 5/1964 | Ward | 118/308 |
| 3,191,574 | 6/1965 | Robertson, Jr. | 118/308 |
| 3,570,451 | 3/1971 | Le Heron et al. | 118/308 |
| 3,716,021 | 2/1973 | Fry | 118/308 |
| 3,802,384 | 4/1974 | Fry | 118/310 |

*Primary Examiner*—Mervin Stein
*Assistant Examiner*—Douglas Salser
*Attorney, Agent, or Firm*—Milton L. Simmons

[57] ABSTRACT

Apparatus for automatic control and deposition of particulate material, such as powdered dry process porcelain enamel or the like, to a heated substrate, utilizing dispensing means adapted to contain particulate material and supported in overlying relation to the article to be coated, with mechanism for oscillating and actuating the dispensing means to provide for controlled application of particulate material to the article. Specifically, an improvement over the apparatus of U.S. Pat. No. 3,802,384 issued Apr. 9, 1974, whereby abutting ends of the dispensing means are biased along a generally vertical plane.

17 Claims, 16 Drawing Figures

DRY PROCESS ENAMEL APPARATUS FOR BATHTUBS

This is a continuation-in-part application of Ser. No. 324,327, filed Jan. 16, 1973, which in turn is a continuation-in-part of Ser. No. 250,786, filed May 5, 1972.

This invention relates in general to application of particulate material to an article, and more particularly, relates to a mechanism for expeditiously applying powdered dry process porcelain enamel or the like to a heated metal article, such as for instance a bathtub, in connection with application of a hard vitreous coating thereto when cooled.

BACKGROUND OF THE INVENTION

The application of powdered porcelain enamel to sanitary ware appliances, such as for instance metal bathtubs, sinks and the like, has traditionally been carried out by heating the article or casting to be coated to a predetermined temperature, withdrawing the casting from the heating furnace and placing it in a cradle adapted to be tilted through a 90° arc and rotatable approximately 360°, with an operator standing over the hot casting and manually sifting powdered porcelain enamel onto the heated article and while it is manipulated in the cradle to present various surfaces to the cascading powder coating material.

The heat of the base metal of the article causes the powdered porcelain enamel coming in contact therewith to fuse and adhere thereto, and the process is usually repeated with reheating of the casting two or three times until a sufficiently thick coating of vitreous enamel has been built up on the surface of the article, to thereby provide a protective coating thereto. Following the enameling procedure, the casting is allowed to cool, whereupon the vitreous coating becomes hard and glossy, and the article is ready for distribution and installation. The manual application of the particulate material to the article is an expensive and time consuming procedure, and has presented many problems.

SUMMARY OF THE INVENTION

The present invention provides a mechanism for automatically applying a coating of particulate material to an article such as a heated sanitary wear casting (for instance, a bathtub) during manipulation of the latter, to insure even and effective coating of the article with utilization of relatively unskilled labor, or possibly no manual control whatsoever, utilizing instead automatic control systems for obtaining controlled operation of the coating applying mechanism. The apparatus' dispensing mechanism containing a particulate material is supported in overlying relation to the article or part to be coated, and means are provided for oscillating the sieve-like dispensing mechanism during operation thereof in the process of applying the particulate material, so as to evenly dust the paticulated material onto selected surfaces of the article.

Accordingly, it is an object of the invention to provide a novel apparatus for the deposition of particulate material onto a predetermined area of an article.

It is further an object of the invention to provide an improved apparatus for the deposition of particulate powdered porcelain enamel onto a cast metal substrate and particularly concavities and contiguous surfaces thereof, and in a manner wherein the particulate material is evenly applied to all surfaces of the article wherein a coating is desired.

It is a further object of this invention to provide an apparatus for the deposition of particulate powdered porcelain enamel onto a cast metal substrate and particularly concavities and contiguous surfaces thereof, and in a manner wherein the particulate material is evenly applied to all surfaces of the article wherein a coating is desired.

It is a further object of this invention to provide an apparatus for the deposition of particulate material onto a predetermined area of an article having a concavity and contiguous surfaces, to insure an even coating thereof with particulate material.

Other objects and advantages of the invention will be apparent from the following description taken in conjunction with the accompanying drawings.

DESCRIPTION OF PREFERRED EMBODIMENTS

Figure 1:
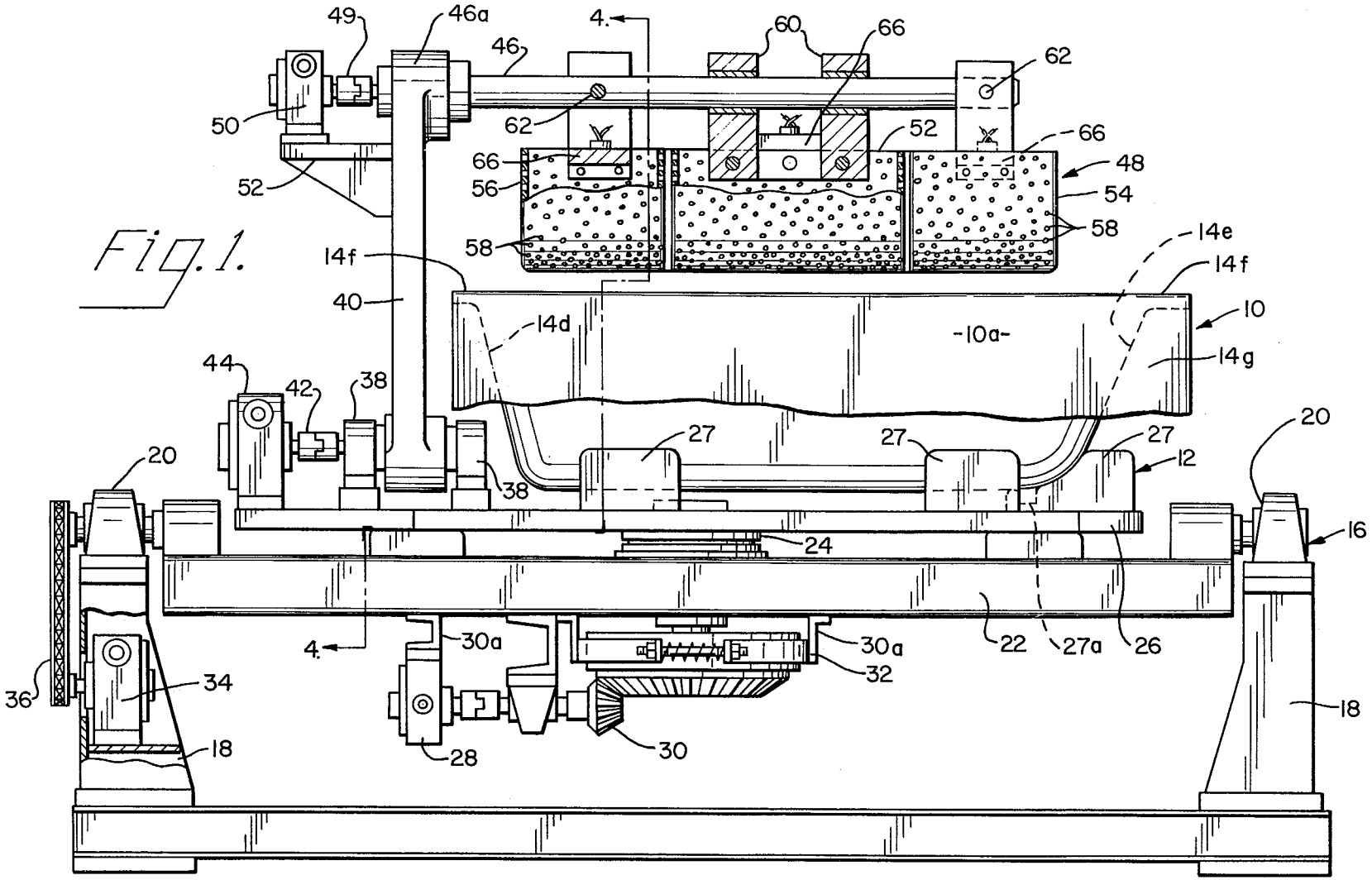
FIG. 1 is a side elevational, partially broken, generally diagramatic view of apparatus embodying the invention, and illustrating a bathtub positioned on the apparatus for coating by the sieve-like dispensing mechanism overlying the tub.
Figure 2:
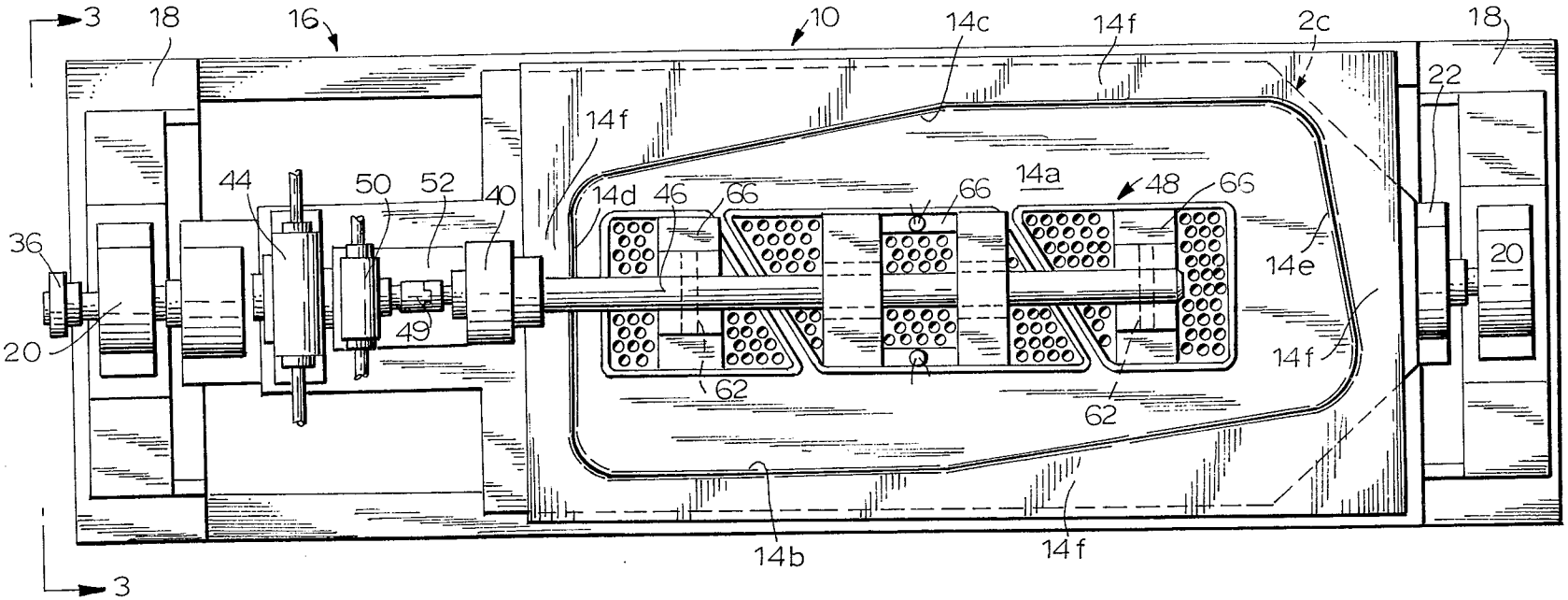
FIG. 2 is a top plan view of the apparatus of FIG. 1.

Referring now to FIGS. 1 and 2, there is illustrated the apparatus of the invention with a built-in type bathtub 10, which includes in the embodiment illustrated a front apron portion 10*a* and resting in a cradle support 12 of the apparatus. The article 10 is illustrated in the position it would normally assume after it has been taken from a heating furnace and placed on the apparatus just prior to or subsequent to the enameling operation. The tub 10 includes the usual concavity defined by bottom surface 14*a*, side surfaces 14*b* and 14*c*, and end surfaces 14*d* and 14*e*. The tub also includes the substantially horizontal ledge surfaces 14*f*, and the front surface 14*g* of the aforementioned apron 10*a*, all of which adapted to be coated with enamel in accordance with usual practice.

Cradle 12 comprises a part of the base 16 of the apparatus, which base is pivotable and rotatable in a manner herinafter described in order to properly present all of the surfaces of the article that are to be enameled. Base 16 may include laterally spaced legs 18 (FIG. 1) which may be firmly attached to a floor surface, and on which is journaled, as at 20, and as by means of trunnions, a swingable beam assembly 22 of the base 16. Rotatably mounted on beam support 22 for rotation about a generally vertically axis and as by means of rotatable support member 24 (FIG. 1) is a table 26 comprising the aforementioned cradle 12. Mounted on table 26 are cradle supports 27 positioned for supporting and retaining the sanitary wear article on the table. The tub may be provided with a lug 27*a* (FIG. 1) integrally formed thereon coacting with a confronting one of cradle supports 27 for preventing movement of the tub 10 with respect to the cradle in at least one direction, or any other suitable arrangement can be provided for maintaining the tub stationary during rotary and/or tilting movements of the cradle. The cradle supports 27 are preferably removably mounted by any suitable means on the table 26, so that different sizes and/or different configurations of articles can be conveniently mounted on the table 26.

Table 26 and associated support 24 may be rotated preferably through 360° while in an upright, or in a tilted position, and by any suitable power means, such as for instance reversible, rotatable fluid motor unit 28. Motor unit 28 may be operatively coupled to the support 24 for rotation of the latter as by means of gearing 30, and may be suspended from the beam assembly 22 as at 30*a*. A braking mechanism 32 may be provided in conjunction with the gearing 30, for frictionally resisting free rotation of the support member 24 and associated table 26.

Beam assembly 22 and the supported table 26 of the base 16 may be tilted sideways with respect to the vertical plane passing through the lengthwise axis of journals 20 thereof, by any suitable means, such as for instance reversible fluid powered motor unit 34, which may be operatively coupled as by means of chain and sprocket drive 36 (FIG. 1) to the beam assembly 22 for selective tilting thereof. The motor unit 34 is preferably so controlled as by means of suitable valving mechanism (not shown) that the beam assembly 22 and associated table 26 can be tilted through a predetermined range (e.g. 60° ) with respect to the vertical plane passing through the axes of journals 20, although a tilt of approximately 45° may be adequately satisfactory for applying the powdered enamel to the concavity and contiguous surfaces of the tub illustrated.

Mounted on bearing supports 38 which are secured to the table 26 is a support arm 40, which is adapted for movement with the table during rotation and tilting thereof. Support arm 40 is operatively coupled as by means of coupling 42, to fluid powered motor unit 44 which is adapted for pivoting support arm 40 in a generally vertical plane with respect to table 26, and about an axis passing through the bearing support members 38. Support arm 40 projects upwardly from the table and has a support shaft 46 rotatably mounted thereon in bearing portion 46*a*.

Support shaft 46 projects laterally of arm 40 in generally overlying relation to the cradle 12, and mounts thereon particulate material dispensing mechanism 48. Shaft 46 is operatively coupled as by means of coupling 49 to fluid powered motor unit 50, which is mounted on a bracket 52 attached to arm 40, for movement therewith.

Figure 3:
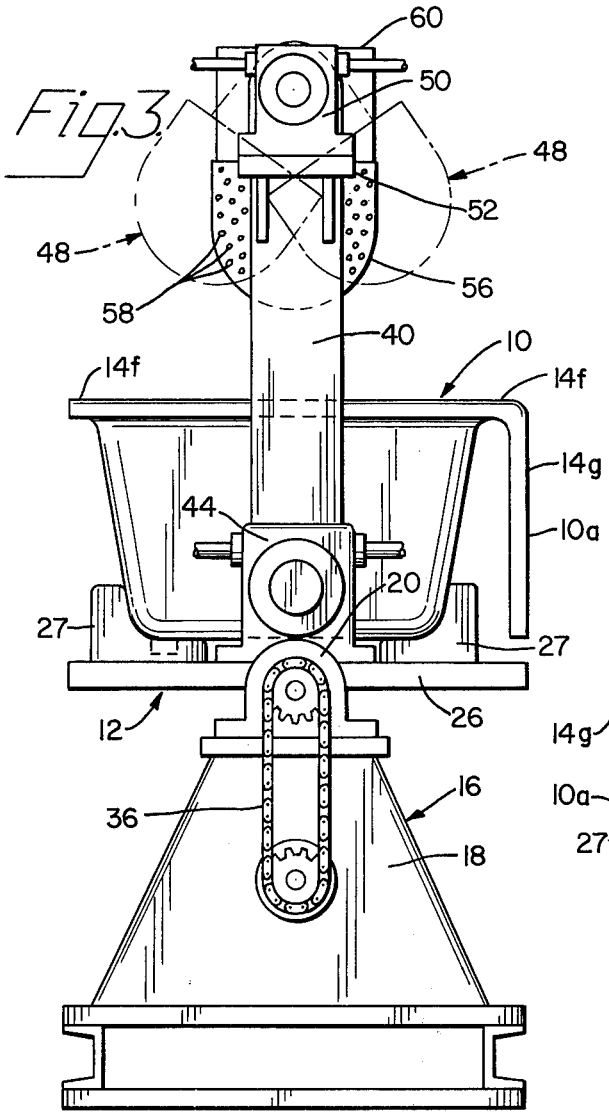
FIG. 3 is an end elevational view taken generally along the plane of line 3—3 of FIG. 2, looking in the direction of the arrows.
Figure 4:
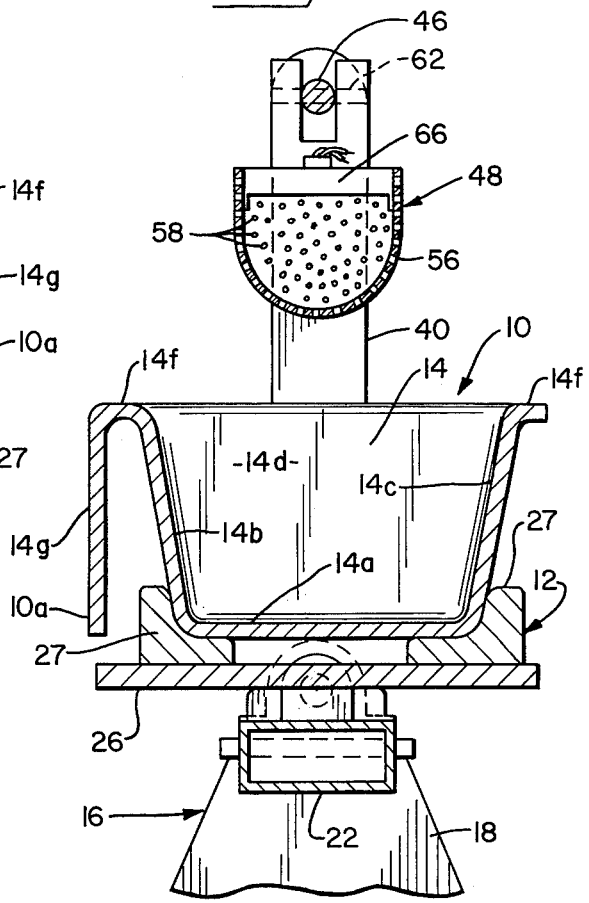
FIG. 4 is a sectional view taken generally along the plane of line 4—4 of FIG. 1 looking in the direction of the arrows.

Dispensing mechanism 48, in the embodiment illustrated, comprises a central member 52 which provides a sieve-like basket housing adapted to contain particulate material such as the aforementioned powdered enamel, for subsequent application to the article to be coated. Dispensing mechanism 48, in the embodiment illustrated, also includes end sieve-like basket members 54 and 56. Members 52, 54 and 56 are uniformly perforated, as at 58, and each is adapted to contain a supply of the particulate material to a selected level therein. As can be best seen from FIGS. 3 and 4, in transverse cross-section members 52, 54 and 56 are of generally arcuate configuration on the undersides thereof, with perforations preferably running completely up the side walls and end walls thereof. Middle member 52 is preferably fixedly supported on shaft 46, by means of bracket support 60, while end members 54 and 56 are pivoted as at 62 to the shaft, for pivotal movement with respect thereto in a generally vertical plane passing through the lengthwise axis of shaft 46.

Mounted on each sieve housing and coacting therewith is a suitable power means, such as an electric vibrator mechanism 66, for vibrating or shaking the respective sieve member. Vibrator mechanisms 66 may be of the variable speed type for selectively controlling the degree of vibrating movement of the respective sieve member. While only one vibrator mechanism is shown associated with each of members 54, 56, it will be understood that plural vibrators may be mounted on each sieve member if so desired. With such arrangement, the dispensing mechanism 48 is supported in overlying relationship with respect to the article to be coated, with such dispensing mechanism being swingable by means of the oscillating support shaft 46, and being movable by means of the pivotal support arm 40, to effectively coat various surfaces of the article, and as will be hereinafter described in greater detail.

As best illustrated in FIG. 2, the abutting, corresponding ends of sieve members 52, 54 and 56 are biased in a generally vertical plane, the improvement hereof over the squared ends of the apparatus disclosed in U.S. Pat. No. 3,802,384.

Operation of the mechanism for uniformly and effectively coating the article supported in the cradle 12 may be as follows: With the base including the horizontal table 26 in a generally horizontal position, as shown for instance in FIGS. 1, 2 and 3, and with the support arm 40 being generally perpendicular with respect to the table support surface, as illustrated, the motor unit 50 may be operated to cause powered oscillation of shaft 46 through a range of movement of approximately 90° and from one side to the other side of a vertical plane passing through the lengthwise axis of the shaft 46. At the same time, the vibrator mechanisms 66 may be actuated, whereupon particulate material such as the powdered enamel, disposed in the sieve-like basket members 52, 54 and 56, is caused to cascade down in an evenly applied pattern to coat the entire bottom surface 14*a* of the concavity 14 of the tub 10, with a uniform layer of enamel. The uniform oscillation of shaft 46 with respect to the arm 40 causes the enamel to be uniformly applied to the bottom of the tub and expeditiously provides a protective coating to the tub, having a pleasing smooth appearance, and a high degree of chemical resistance.

The biased, abutting ends of sieve members 52, 54 and 56 greatly enhance uniform powder deposition by overlapping and feathering deposition from the abutting ends of members 52, 54 and 56, thereby minimizing any tendency for caps in the coating, as might occur using square butted sieve members.

Figure 5:
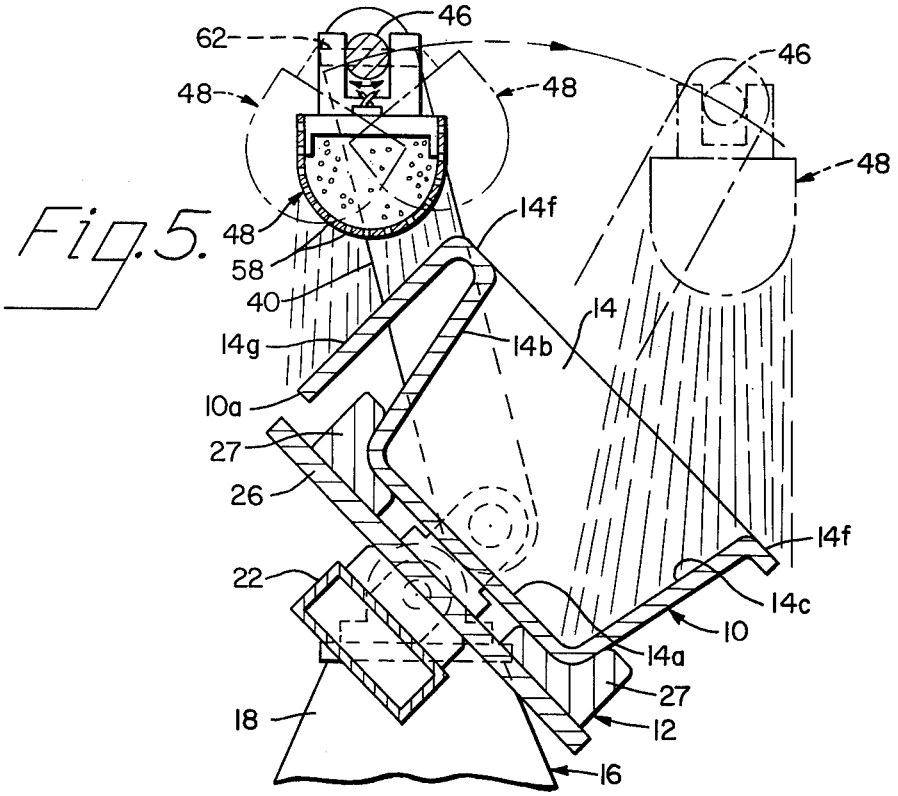
FIG. 5 is a diagrammatic view generally similar to FIG. 4, but illustrating the tilting of the base of the apparatus and the movement of the support arm of the apparatus, for coating predetermined surfaces of the article.

Thereafter, the beam 22 and associated rotatable platform or table 26 may be tilted with respect to the horizontal, as shown for instance in FIG. 5, to an angle of, for instance, approximately 45° with respect to the horizontal, and the support arm 40 may be swung or pivoted, as illustrated, to position the particulate dispensing mechanism 48 above the interior side surface 14*c* of the concavity 14 of the article, whereupon the support shaft 46 can again be oscillated by means of motor unit 50, to either side of a vertical plane passing through the lengthwise axis of the support shaft 46, and while the vibrator mechanisms 66 are energized, to cause a uniform dusting of the enamel material onto the surface 14*c* and contiguous flange surface 14*f*. Likewise the support arm 40 can be swung to position the dispensing mechanism 48 above the apron surface 14*g*, and oscillation of the shaft 46 while energization of the vibrator mechanisms 66 occurs, applies a uniform coating of the enamel material to the underlying surface 14*g* and contiguous flange surface 14*f* of the article. The control for motor unit 50 is preferably such that oscillation of shaft 46 through a range of less than the aforementioned 90° is readily obtainable in order to readily adapt the apparatus to various sizes and configurations of articles for coating thereof.

Figure 6:
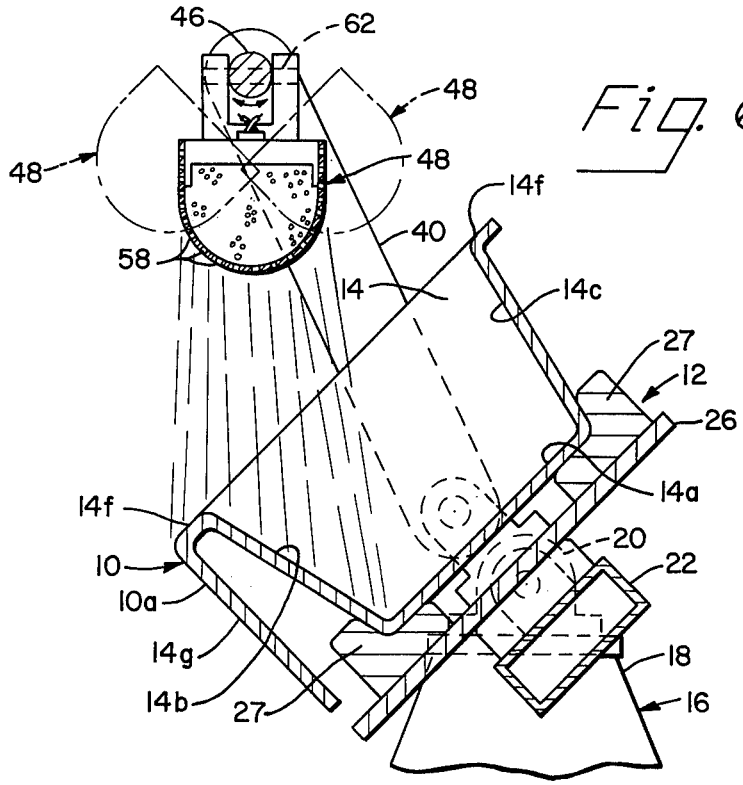
FIG. 6 is a view similar to FIG. 5 but showing tilting of the base of the apparatus so as to position the article in proper attitude for coating another surface of the article.

Tilting of the beam 22 and associated table 26 to the opposite side, as shown for instance in FIG. 6, and angling of the support arm 40, presents the opposite interior side surface 14*b* of the article in underlying relation to the dispensing mechanism 48, and during oscillation of the shaft 46 and associated vibration or energization of the vibrator mechanisms 66, causes a uniform coating of particulate enamel material to be applied to such underlying surface 14*b*.

Figure 7:
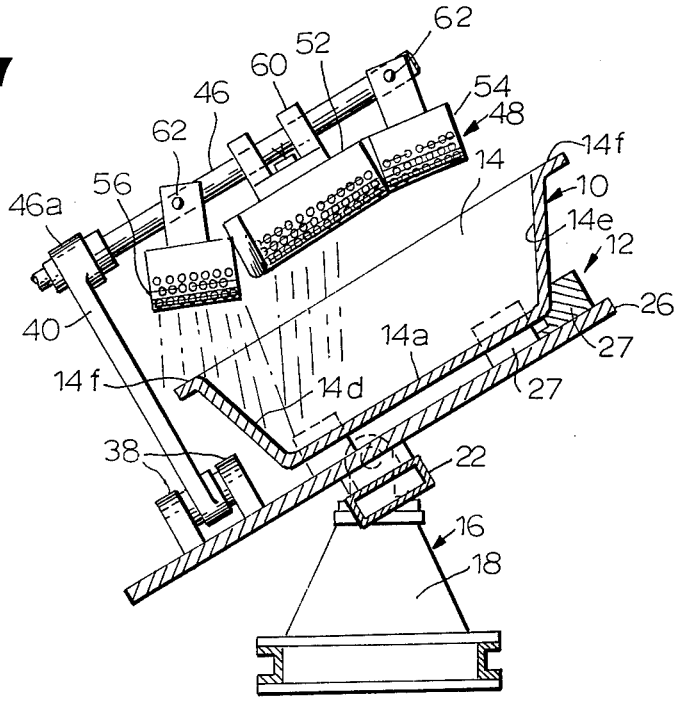
FIG. 7 is a reduced size, illustration showing end-wise tilting of the base of the apparatus, for providing for coating of the interior surface of one end of the article, and illustrating the pivotal movement of one of the sieve-like dispensing baskets with respect to its support shaft, for orienting the dispensing member in proper position for optimum coating of the underlying end surface and contiguous flange surfaces of the article.

Referring now to FIG. 7, in order to expeditiously and uniformly apply the particulate material to the interior end surface 14*d* the concavity of the article, the support arm 40 can be oriented substantially perpendicular to the plane of the table 26, and the table can be rotated with respect to the beam 22, and as by means of more unit 28, to position surface 14*d* in underlying relation to sieve member 56 of the dispensing mechanism.

Figure 8:
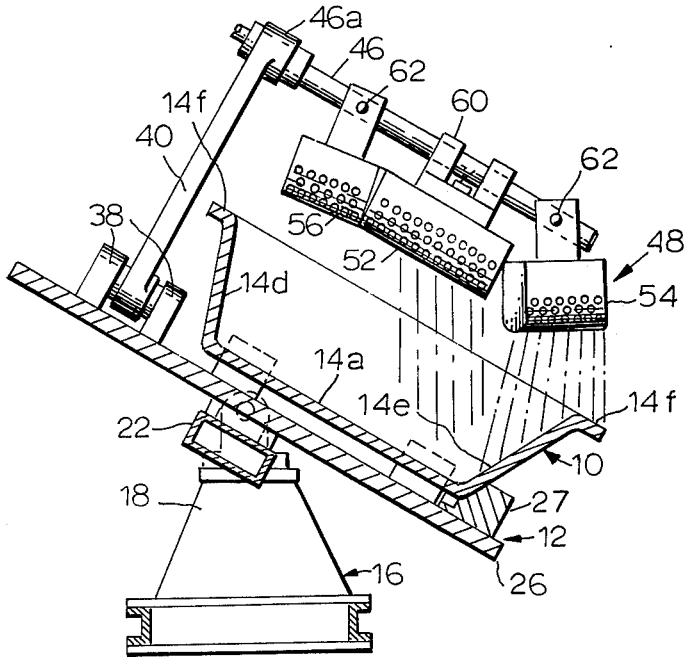
FIG. 8 is a view similar to FIG. 7, but showing tilting of the base toward the opposite end thereof, for coating the corresponding opposite end surface and contiguous flange surfaces of the article.

In this connection, it will be seen that the pivotal mounting 62 of member 56 with respect to the support shaft 46 causes member 56 to swing, due to gravity, substantially to the position illustrated, and upon oscillation of the shaft 46 and associated selective energization of vibrator mechanism 66 of sieve member 56, the powdered enamel material in member 56 will be applied uniformly to the underlying end surface 14*d* and associated contiguous flange surface 14*f* of the article. Thereafter, the beam 22 may be tilted in the opposite direction as shown in FIG. 8, and as by means of motor unit 34, where upon the sieve-like member 54 will pivot with respect to the support shaft 46, substantially to the position illustrated in FIG. 8, and upon oscillation of shaft 46 and associated selective energization of vibrator mechanism 66 of member 54, the particulate material in member 54 will be uniformly applied to the underlying end surface 14*e* of the article being coated. It will be seen therefore that the apparatus provides for optimum application of the particulate material to all surfaces of the article that are desired to be coated and in a manner whereby rapid application of the particulate material to the article may be accomplished.

Thereafter, with the mechanism in a position illustrated for instance in FIG. 8, or in FIG. 7, the motor unit 28 can be actuated to cause rotation of the platform 26 and supported article, with respect to the tipped or tilted beam portion 22, and oscillation of the support shaft 46 and associated energization of the vibrator mechanisms 66 of the dispensing assembly 48 will cause application of the powdered particulate material to cascade down upon the concavity of the article and associated contiguous flange surfaces. During rotation of the platform, the supported article and the dispensing mechanism, a uniform finishing coat of enamel is applied to the article. If so desired, the article can be reheated in the furnace, prior to application of the latter finishing coat.

While the above-described sequence of the application of powdered material to the various surfaces has been described commencing with application to the bottom surface 14*a* of the concavity of the article, it will be understood that said sequence is not usually critical, and application of the coating material may be commenced with one of the side surfaces 14*b* or 14*c*, or one of the end surfaces 14*d* or 14*e*, the same general results being obtained of an expeditious uniform application of particulate material to all of the surfaces of the article which are desired to be ocated. Moreover, in certain instances it may be possible to properly coat the article without applying the aforementioned finishing coat occasioned by rotation of the platform and supported article in a tilted position as described above. Moreover, application of the above-described finishing coat in the manner as set forth may be adequate in certain instances or with certain articles, without the necessity of initially applying the preliminary coats to the various individual surfaces, in the manner described.

Figure 9:
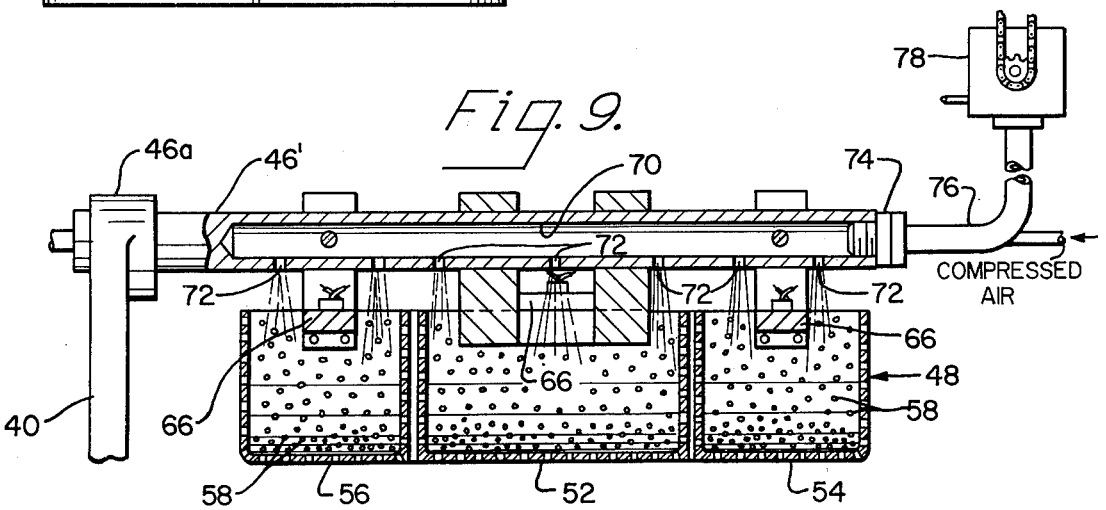
FIG. 9 is an enlarged, fragmentary, side elevational, partially sectioned view, illustrating a modified arrangement of support for the sieve-like dispensing mechanism which contains the particulate material, for expeditiously supplying the particulate material to the dispensing mechanism.

Referring now to FIG. 9, there is shown a modified form of support shaft 46′ which is provided with a passageway 70 extending lengthwise thereof, with orifices 72 provided in the shaft 46′, disposed in overlying relationship to the open upper ends of the sieve-like members 52, 54 and 56 of the dispensing mechanism 48. A coupling 74 may be provided on the shaft which is adapted for rapid coupling with preferably flexible hose 76 attached to a source of the particulate material. Upon actuation of the supply mechanism 78, particulate material can be transmitted via hose 76 to passageway 70 in shaft 46' whereupon it passes through the orifices 72 and into the dispensing baskets 52, 54 and 56, to replenish the supply of particulate material therein. Reference may be had to applicant's U.S. Pat. No. 3,425,601 issued Feb. 4, 1969 and entitled Applicator For Particulate Material, which discloses a supply system which could be utilized for the supply mechanism 78, and the finishing of particulate material via flexible hose 76 to the apertured support shaft 46', thus making provision for and facilitating the maintenance of a predetermined amount of particulate material in the dispensing mechanism 48.

Referring now to FIGS. 10 through 14, there is illustrated a further embodiment of the invention. Like parts have been designated with the same reference number as in the first described embodiment, except that the suffix prime (') has been added thereto.

Figure 10:
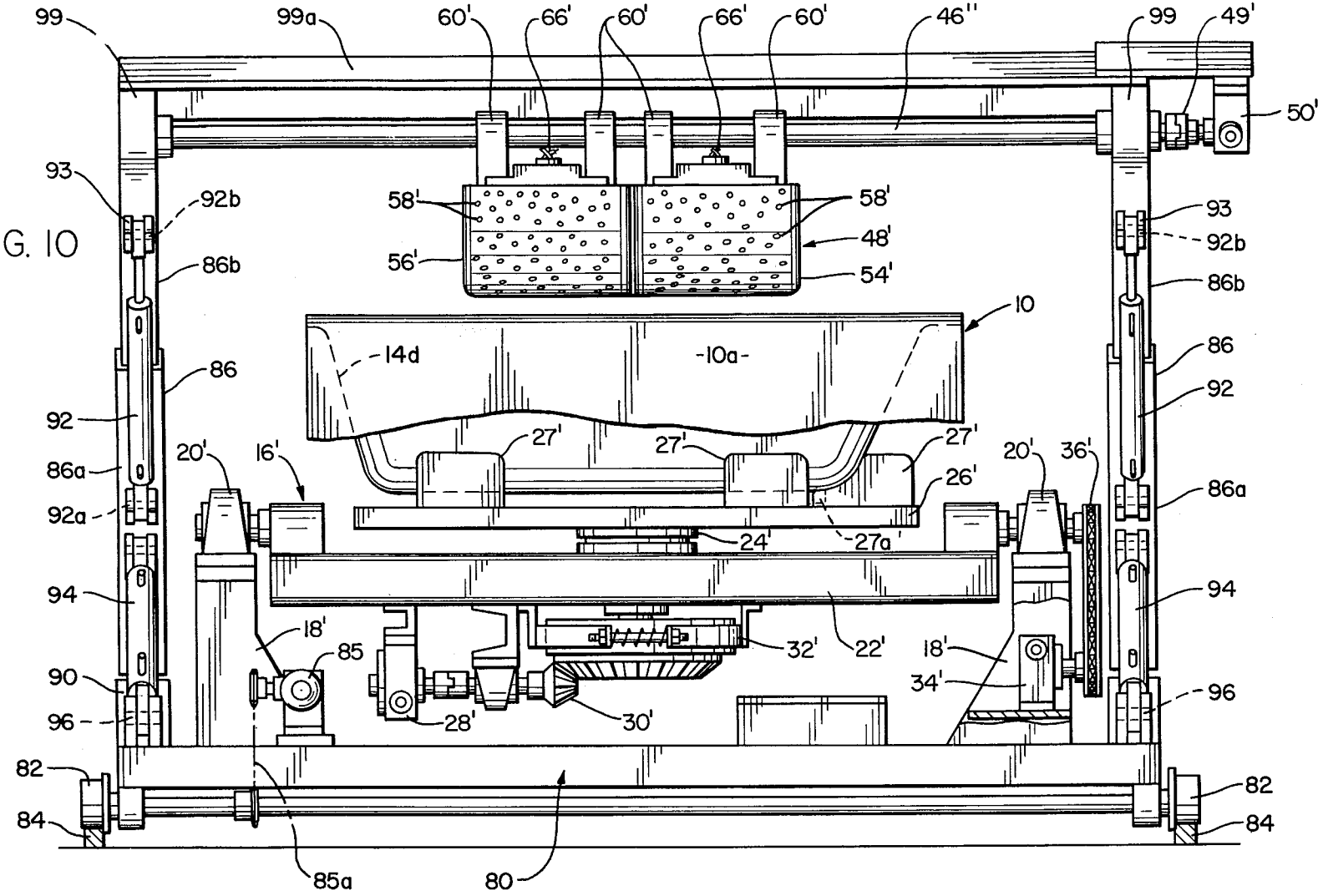
FIG. 10 is a view generally similar to that of FIG. 1, but showing a further embodiment of the invention.
Figure 11:
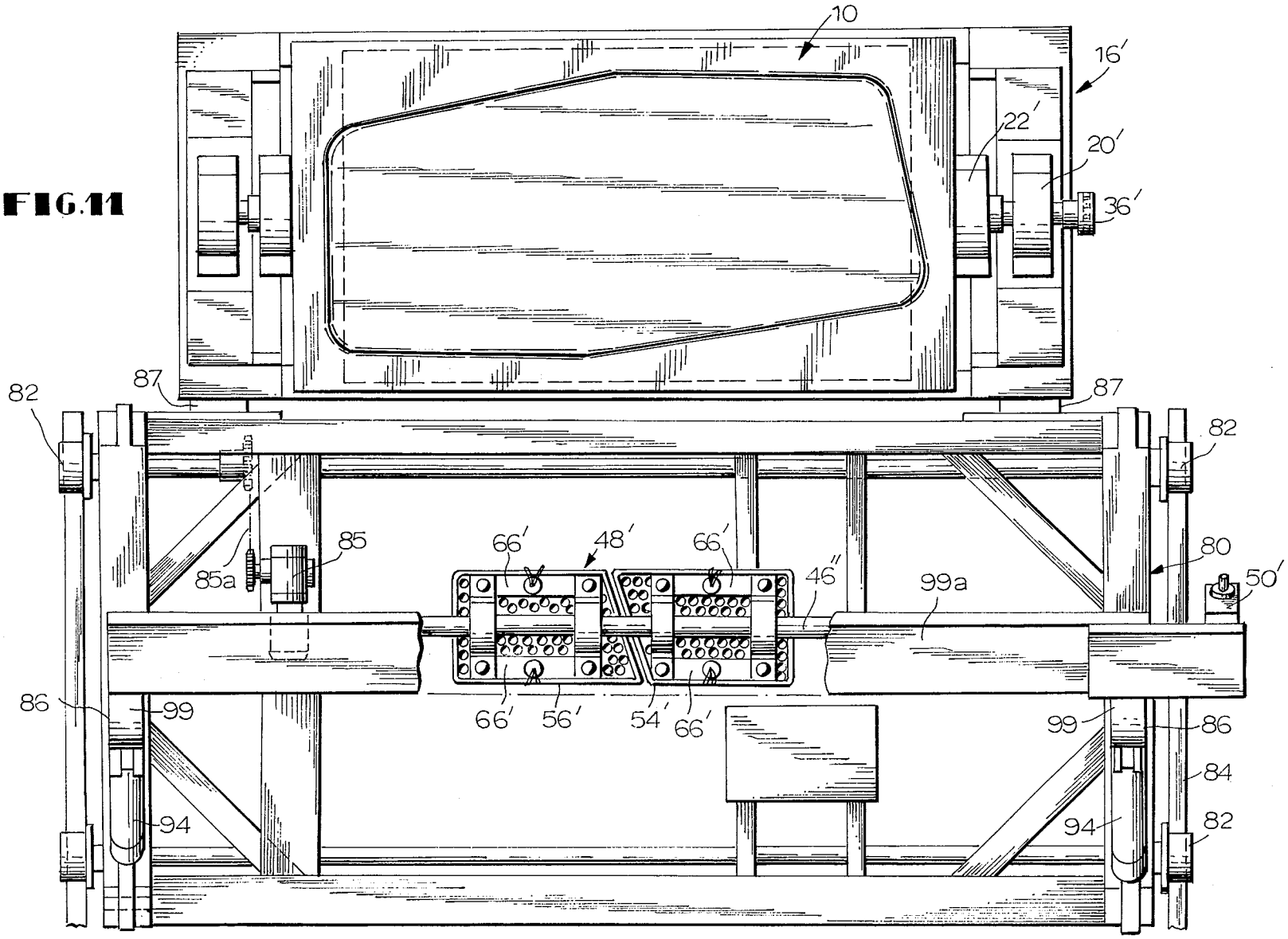
FIG. 11 is a broken top plan view of the embodiment of FIG. 10.

While only two sieve members, 54' and 56' are shown in FIG. 10, three, even four or more, could be employed depending upon the size and configuration of the article to be coated.

In this embodiment, the support means 40' which mounts thereon the particulate material dispensing mechanism 48', comprises a carriage 80 which is completely separate from the rotatable and tiltable base 16' of the apparatus. Carraige 80 may be movably mounted as by means of rotatable wheels 82, which may run on trackways 84. Carriage 80 may be powered as by means of rotary reversible fluid motor 85 operatively coupled as at 85*a* (FIG. 12) to the wheels. Bumpers 87 may be provided between carriage 80 and base 16'.

The movable support means 40' in the embodiment illustrated, also comprises a pair of laterally spaced arms 86 (FIGS. 10 and 11) each of which is of an extensible type, comprising a lower section 86*a* pivotally mounted as at 88 to support bracket 90 on carriage 80, and an upper extendible and retractible section 86*b* which is adapted to telescope into and out of the lower section 86*a*.

A fluid powered, extendible and retractible double acting motor unit or ram 92 may be provided coacting with each of the arms 86, and which is pivoted as at 92*a* to the lower section 86*a*, and at 92*b* to a bracket 93 on the upper section 86*b* of the respective arm, for selectively extending and retracting the arm. Likewise an extendible and retractible double acting motor unit or ram 94 may be provided, coacting with each of the arms 86, and pivotally mounted as at 96 to the carriage 80 and as at 98 to the respective arm 86, for moving or swinging the arms 86 in unison about their respective pivots 88.

Extending between the arms 86 and rotatably mounted relative thereto for oscillating movement, and preferably on bearings, is a support shaft 46'' on which the particulate dispensing mechanism 48' is mounted, in a generally similar manner as in the first described embodiment. As can be seen, in this embodiment of the invention, the particulate material dispensing mechanism 48' comprises two sieve-like basket housings 54', 56' preferably fixedly supported or secured to the shaft 46'' by means of the respective bracket support 60'. Vibrator mechanisms 66' which again may be of the electrical, variable speed type for selectively controlling the degree of vibrating movement of the respective sieve member, are mounted on each respective sieve housing, for vibrating or shaking the respective sieve member 54' or 56'. As in the preceding embodiment, the abutting ends of members 54' and 56' are biased.

With such an arrangement, the dispensing mechanism 48' is swingable about the lengthwise axis of shaft 46'' by means of the oscillatory support shaft 46'', and is movable by means of the pivotal support arms 86 into overlying relationship to the article to be coated with the particulate material. While the arms 86 are illustrated as being spaced a sufficient distance to more or less straddle the base 16' and the article being coated, when the arms are swung forwardly in unison by means of the motor units 94, so as to position the particulate dispensing mechanism 48' and the associated support shaft 46'' in overlying relationship with respect to the article 10 being coated, as shown for instance in FIGS. 13 and 16, it will be understood that the arms 86 do not necessarily have to straddle the base and article. In this connection the arms could be closer together and be of greater lengthwise extent, or the laterally extending mech portions 99 of outer sections 86*b* of the arms could be of greater lengthwise extent. The carriage would then usually be maintained at a greater distance from the support base 16' but the same effect would be realized, primarily that of positioning the oscillatory particulate material dispensing mechanism 48' in overlying relationship to the article to be coated, and in a manner whereby the support arms would be out of interfering relationship with respect to the tiltable and rotatable table 26' of the base, so as to not interfere with the rotatable and tiltable movements of the base and associated supported article. Cross member 99*a* secured to neck portions 99 connects arms 86 and provides the bearing support for shaft 46''.

Figure 15:
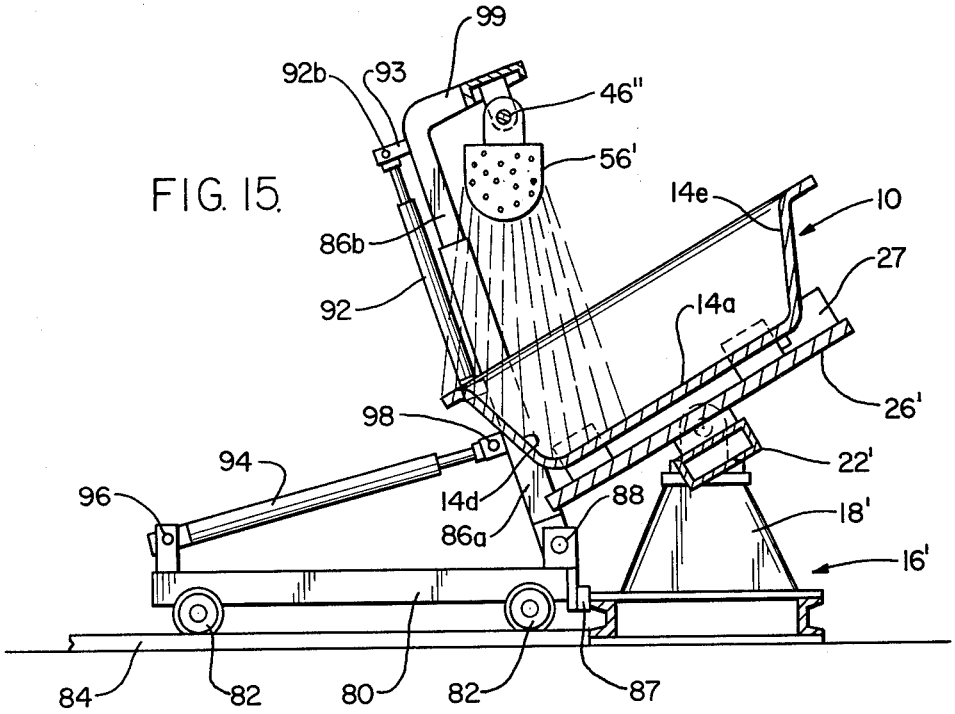
FIGS. 15 and 16 are reduced size illustrations, showing tilting of the base and movement of the support arms of the apparatus, for coating surfaces at the ends of the article being handled.
Figure 16:
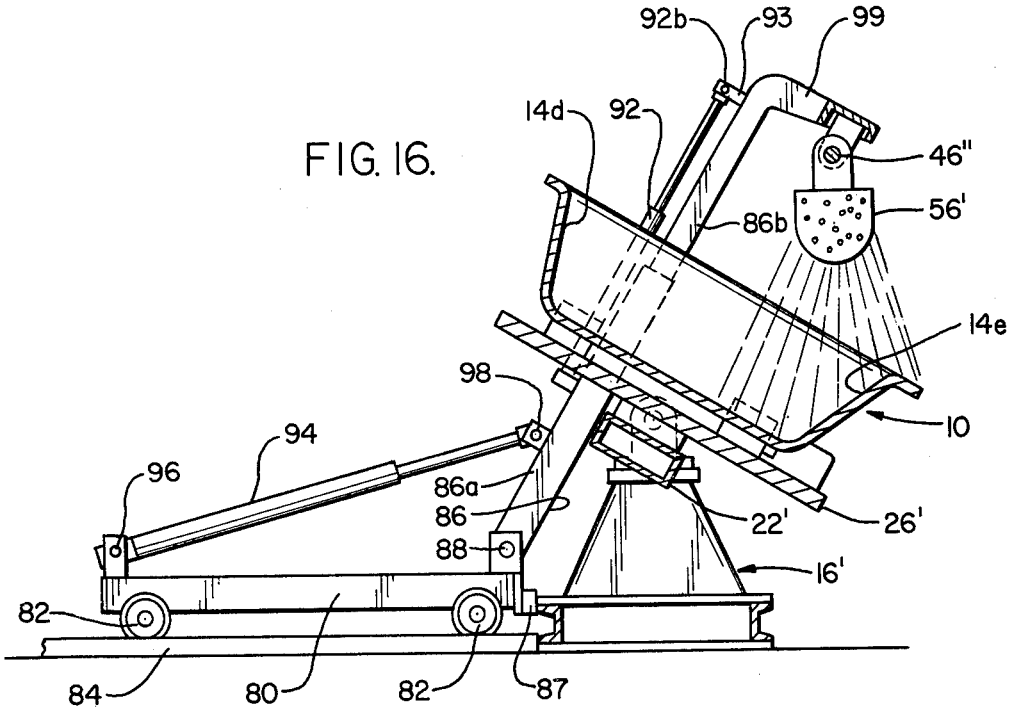

Operation of this embodiment of apparatus may be generally similar to that of the first described embodiment with the exception that the support means 40' has to be moved into coacting relation with the base 16' and the arms 86 positioned with respect to the carriage so as to locate the dispensing means 48' over the article 10. Braking means of conventional type may be provided in conjunction with the power means 85 for the carriage, to maintain the latter in selected position with respect to base 16'. Also it will be seen that the sieve-like basket member 54', 56' in this embodiment are not pivoted to the support shaft 46'', but instead are fixed thereto so that they oscillate with the shaft during oscillating movement of the support shaft, thus applying a uniform cascading of the powdered particulate material down upon the article and upon the associated surfaces thereof upon energization of vibrators 66'. As shown in FIGS. 15 and 16, the platform or table 26' can be rotated and tilted as by means of motor units 28', 34' (FIG. 10) to tilt the article toward either end thereof and in proper position with respect to the overlying oscillatory particulate material dispensing mechanism so that the article can be uniformly dusted with the particulate material and through a predetermined range of movement from an overlying position with respect thereto.

From the foregoing description and accompanying drawings it will be seen that the invention provides a novel apparatus for applying particulate material to an article having a concavity, and possible associated contiguous surfaces, with the apparatus comprising a rotatable and tiltable base and particulate material dispensing mechanism movably mounted on said base, with the apparatus including means for oscillating the dispensing means with respect to the base, for dusting particulate material through a predetermined range of movement onto the article, and from an overlying position with respect thereto.

The invention also provides a novel method of uniformly applying particulate material to an article, such as for instance powdered enamel, to a heated metal article.

While the description of the apparatus and drawings disclose various motor units and mechanisms for actuating the component parts of the apparatus, it will be understood that the conventional automatic control systems may be utilized with the apparatus, such as for instance programmed computers or the like, for obtaining a completely automatically controlled operation of the coating applying mechanism.

As will be apparent, depending upon the design and configuration of the article to be coated and the configuration of the concavity of the article, the apparatus and method of this invention are fully compatible for use in conjunction with certain steps of conventional manual application methods; such as for instance preliminary dusting of the enamel powder could be accomplished on the flanges and bottom surface of the article illustrated for instance in FIG. 1, and then the apparatus could be utilized upon actuation thereof while in a tilted rotating condition, to apply a finishing coat to the surfaces, with such conventional manual steps used supplementary to and cooperatively with the method and/or apparatus of this invention.

Figure 12:
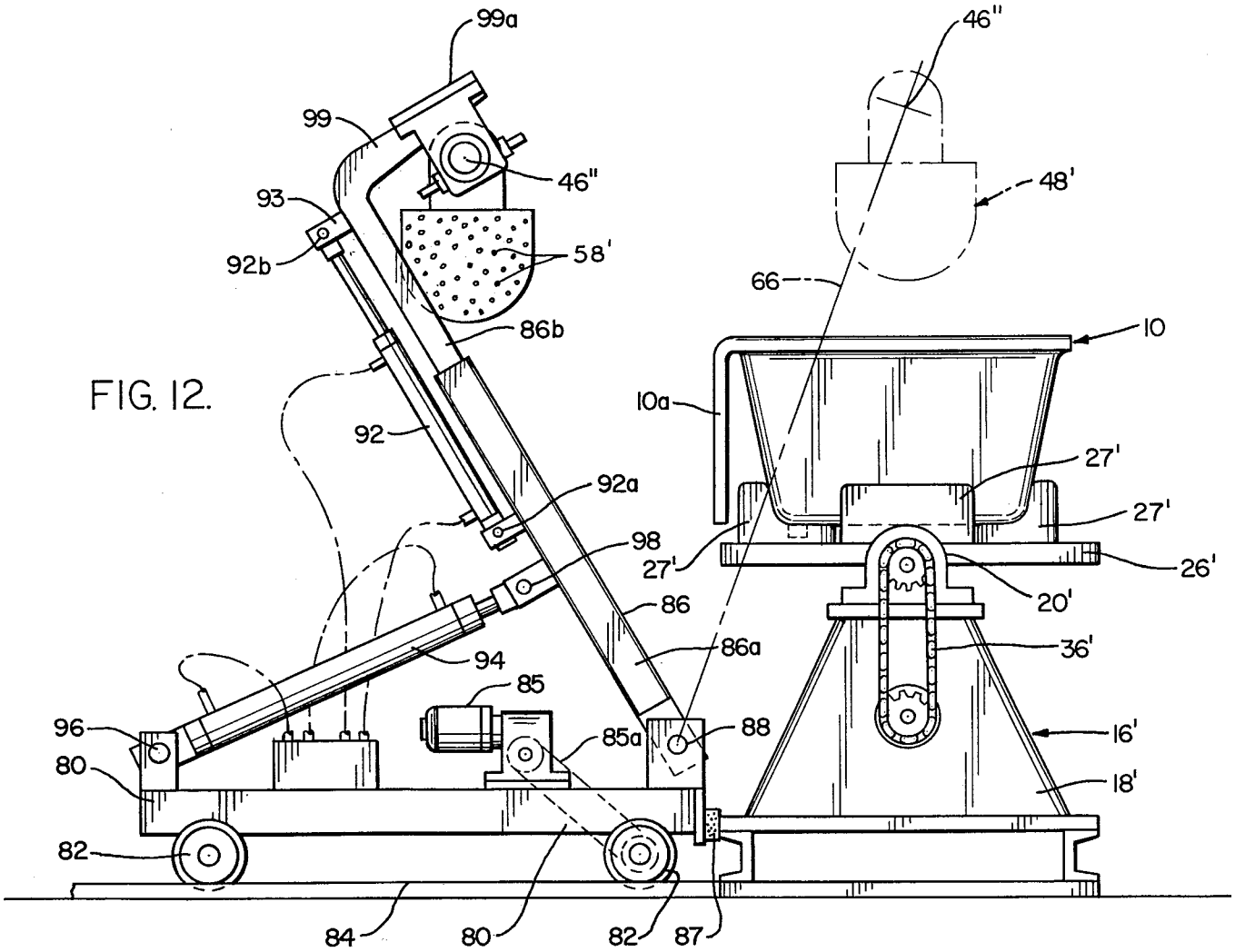
FIG. 12 is a side elevational view taken from the right-hand side of FIG. 11.
Figure 13:
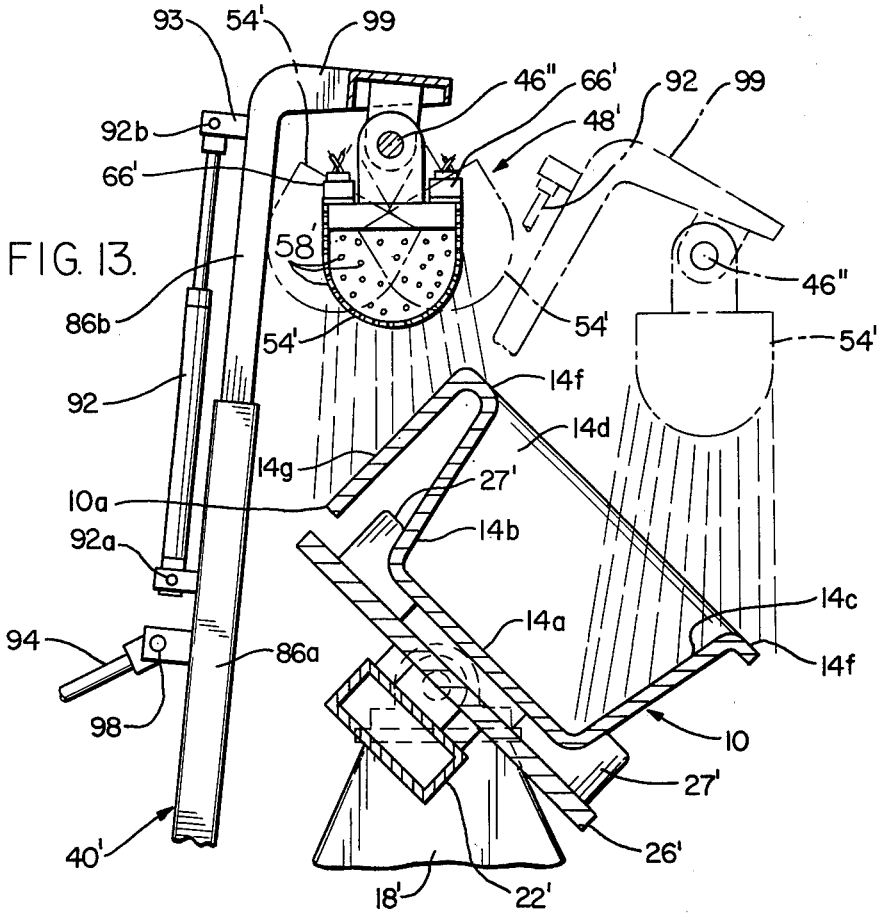
FIGS. 13 and 14 are fragmentary generally diagrammatic, sectional illustrations somewhat similar to FIGS. 5 and 6, illustrating the tilting of the base and movement of the support arms of the apparatus, for coating predetermined surfaces of the article being handled.
Figure 14:
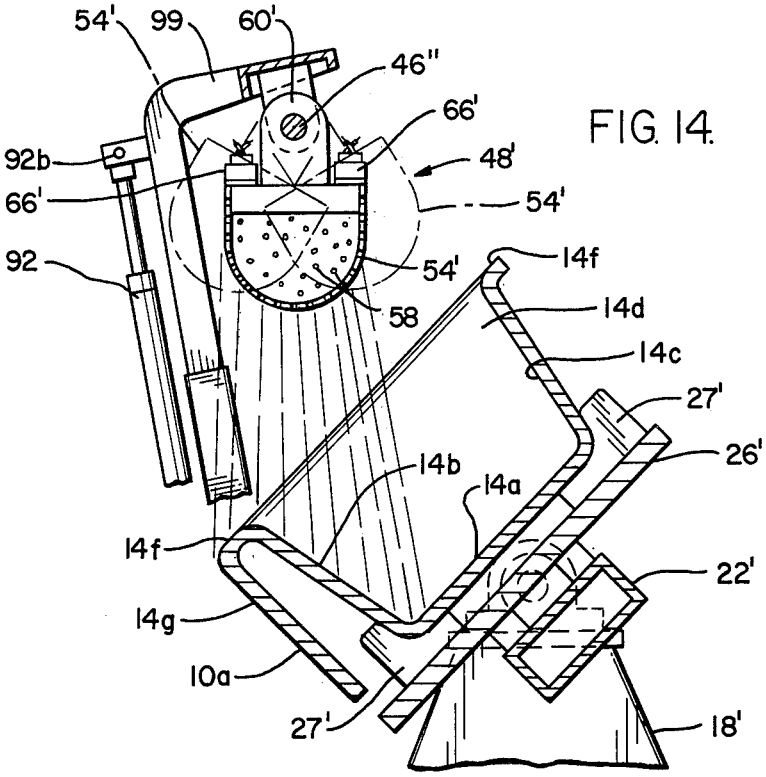

Although FIG. 12 shows the dispensing mechanism mounted on a carriage 80 it is to be understood that the dispensing mechanism could be fixed, further that a second dispensing mechanism could be positioned to the right of the tub depicted in FIG. 12, and utlilized to supplement the function of the first dispensing mechanism.

Too, this invention contemplates that a second series of sieve means could be disposed somewhat below the first, between slightly extended support arms 86, so that when the mechanism is in the position of FIG. 16, the two sets of sieve means would cover a larger area.

The angle of bias is preferably 30° to 85° with a generally vertical plane normal to shaft 46. For practical, fabrication reasons, a bias angle of 40° to 50° would normally be employed.

The terms and expressions that have been used are used as terms of description and not of limitation, and there is no intention in the use of such terms and expressions of excluding any equivalents of any of the features shown or described, or portions thereof, and it is recognized that various modifications are possible within the scope of the invention claimed. What is claimed is:

1. Apparatus for applying particulate material to an article having a concavity and associated contigious surfaces, said apparatus comprising a rotatable and tiltable base, means on said base for holding the article to which particulate material is to be applied, support means coacting with said base, particulate material dispensing means mounted on said support means in upwardly spaced and generally overlying relationship with respect to said base, for directing particulate material downwardly onto the article, said dispensing means segmented, and including means for dispensing particulate material from each segment thereof onto the article when said dispensing means is in predetermined operative positional relationship with respect to the article, means associated with each said segment for lapping its deposition over that of an adjacent segment, and means for oscillating said dispensing means with respect to said base for dusting the particulate material through a predetermined range of travel of said dispensing means down onto the article and from an overlying position with respect thereto, said oscillating means including powered motor means for causing said oscillation of said dispensing means and thus said dusting through said predetermined range.

2. Apparatus in accordance with claim 1 wherein said support means comprises an arm supported on said base and extending upwardly therefrom, a shaft projecting outwardly from said arm in overlying relation to said base and supporting said dispensing means thereon, said motor means being operative to oscillate said shaft and mounted dispensing means with respect to said arm.

3. Apparatus in accordance with claim 2 including power means for rotating said base through 360° and for tilting said base with respect to the vertical through at least approximately 45°, said means for causing dispensing of particulate material from said dispensing means comprising a vibrator mounted on said dispensing means for vibrating said dispensing means to cause cascading of particulate material from said dispensing means upon actuation of said vibrator.

4. Apparatus in accordance with claim 1 wherein said segmented dispensing means comprises a plurality of laterally spaced perforate basket-like members mounted on said support means, said basket members abutting in biased, spaced relationship along a generally vertical plane, at least one of said basket-like members being generally fixed to said support means while another of said basket-like members is pivoted to said support means, said support means being supported by said base whereby said pivoted member automatically swings with respect to said support means due to gravity upon predetermined tilting of said base.

5. Apparatus in accordance with claim 4 wherein said fixed basket-like member is centrally disposed and aligned between pivoted basket-like members, one of said pivoted basket-like members being adapted to dust an associated end of the interior of the concavity of the article while the other of said pivoted basket-like members is adapted to dust the interior of the opposite end of the concavity of the article upon predetermined tilting of said base.

6. Apparatus in accordance with claim 1 wherein said dispensing means comprises a plurality of spaced sieve-like dependent basket members adapted to receive particulate material therein, said basket members abutting in biased, spaced relationship along a generally vertical plane, said means for causing dispensing of particulate material from said dispensing means comprising a vibrating mechanism operatively connected to an associated one of said sieve-like members and adapted to vibrate the respective sieve-like member upon actuation of said vibrating mechanism.

7. Apparatus in accordance with claim 1 wherein the article to be coated comprises a build-in type bathtub including a front exterior apron section, said support means comprising an arm pivoted to said base for movement in a plane disposed generally perpendicular to said base, power means for pivoting said arm, said support means also including a shaft rotatably mounted on said arm in overlying relationship to said base and extending laterally from said arm, said dispensing means being suspended from said shaft, and said powered motor means being operatively coupled to said shaft, for oscillating said shaft about it lengthwise axis and with respect to said arm to cause said oscillation of said dispensing means for dusting the particulate material through a predetermined range of movement onto the article to be coated.

8. Apparatus in accordance wth claim 1 wherein said base comprises a first support member swingable about a generally horizontal axis, a second support member mounted on said first support member for movement therewith and extending generally perpendicular to a horizontal plane containing said horizontal axis, said means for holding an article being mounted on said second support member, and power means for rotating said second support member with respect to said first support member whereby an article to be coated may be tilted and rotated when in supported relation on said holding means.

9. Apparatus in accordance with claim 2 wherein said motor means comprises a fluid powered motor operatively coupled to said shaft and which is adapted to oscillate said shaft through a predetermined arc with respect to said arm and to either side of a generally vertical plane passing through the longitudinal axis of said shaft.

10. Apparatus in accordance with claim 2 wherein said dispensing means comprises a perforate basket-like member open at the top thereof and suspended from said shaft, the last mentioned member comprising a generally outwardly arcuate bottom wall, and generally vertical side and end walls, said walls being perforated substantially throughout their areas of extension.

11. Apparatus in accordance with claim 2 wherein said shaft includes means thereon adapted for supplying particulate material to said dispensing means.

12. Apparatus in accordance with claim 11 wherein said supplying means comprises a passageway in said shaft and means communicating said passageway with said dispensing means for supplying particulate material from said passageway means to said dispensing means, and including means on said shaft adapted for quick coupling with a conduit running from a supply source of the particulate material.

13. Apparatus in accordance with claim 8 wherein said first support member comprises an elongated beam having trunnions at opposite ends thereof, bearing means supporting said trunnions for swinging movement of said beam about said generally horizontal axis, power means operatively coupled with said beam for selectively swinging said beam about said axis, said second support member comprising a turntable support mounted on said beam for rotation about an axis extending generally perpendicular relative to said beam and about the axis of said turntable support, the first mentioned power means coacting with said turntable support for rotating said turntable support with respect to said beam, and said holding means comprising a cradle mounted on said turntable support.

14. Apparatus in accordance with claim 1 wherein said support means comprises a carriage movable toward and away from said base, an arm movably mounted on said carriage for swinging movement in a generally vertical plane and supporting said dispensing means thereon, said dispensing means being oscillatable with respect to said arm and carriage, said carriage and arm being adapted to be so positioned that said dispensing means is located in overlying relation with respect to the article during said dusting.

15. Apparatus in accordance with claim 1 wherein said support means comprises a carriage movable toward and away from said base on tracks, a pair of laterally spaced, extensible and retractable arms pivotably mounted on said carriage, a shaft rotatably supported by said arms and extending therebetween, said shaft supporting said dispensing means thereon, said dispensing means including a plurality of perforated basket-like members adapted to receive therein particulate material, and power means for pivoting said arms relative to said carriage and for extending and retracting said arms, and said motor means being operatively coupled to said shaft for oscillating said shaft about its length axis and thus swinging said basket-like members relative to said holding means and from an overhead position relative thereto.

16. Apparatus in accordance with claim 14 wherein said arm is extensible and retractable lengthwise thereof, including power means for extending and retracting said arm, and other power means for moving said arm relative to said carriage, said dispensing means including a plurality of laterally spaced perforated basket-like members.

17. Apparatus in accordance with claim 14 wherein said arm comprises an elongated lower section movably mounted on said carriage and an elongated upper section extensible and retractable relative to said lower section, said upper section including a laterally extending end portion on which said dispensing means is mounted, said end portion extending in the general direction of said base.

* * * * *